US008387296B2

(12) United States Patent
Overstreet et al.

(10) Patent No.: US 8,387,296 B2
(45) Date of Patent: Mar. 5, 2013

(54) DROP BOLT HOLD OPEN ACTUATOR FOR USE WITH AR-15/M16 TYPE FIREARMS AND INCORPORATING A MODIFIED AND DISPLACEABLE FOLLOWER FOR ENGAGING A BOLT CATCH MECHANISM SUCH AS IN CONJUNCTION WITH RIMFIRE AMMUNITION

(75) Inventors: John L. Overstreet, Fayette, MO (US); Jordan Bowles, Columbia, MO (US); Tyson Bradshaw, Kirksville, MO (US); Craig Pudil, Boonville, MO (US)

(73) Assignee: 22 Evolution LLC, Columbia, MI (US)

( * ) Notice: Subject to any disclaimer, the term of this patent is extended or adjusted under 35 U.S.C. 154(b) by 181 days.

(21) Appl. No.: 12/986,454

(22) Filed: Jan. 7, 2011

(65) Prior Publication Data

US 2011/0247482 A1 Oct. 13, 2011

Related U.S. Application Data

(60) Provisional application No. 61/321,942, filed on Apr. 8, 2010.

(51) Int. Cl.
*F41A 17/36* (2006.01)

(52) U.S. Cl. ..... 42/50; 42/70.02; 89/197

(58) Field of Classification Search ..... 42/70.02, 42/49.01, 50; 89/196, 197
See application file for complete search history.

(56) References Cited

U.S. PATENT DOCUMENTS

| | | | | |
|---|---|---|---|---|
| 2,538,799 | A * | 1/1951 | Phillips et al. | 89/138 |
| 3,540,142 | A | 11/1970 | Vartanian et al. | |
| 3,570,366 | A | 3/1971 | Nickel | |
| 3,688,640 | A | 9/1972 | Louis W. Seecamp | |
| 3,846,928 | A | 11/1974 | Ruger et al. | |
| 4,057,003 | A | 11/1977 | Atchisson | |
| 4,455,919 | A | 6/1984 | Osborne et al. | |
| 4,893,547 | A | 1/1990 | Atchisson | |
| 5,608,981 | A | 3/1997 | Canaday | |
| 5,638,626 | A | 6/1997 | Westrom | |
| 6,070,352 | A * | 6/2000 | Daigle | 42/49.02 |
| 6,510,778 | B1 | 1/2003 | Irwin | |
| 6,606,811 | B1 | 8/2003 | Olson | |
| 6,608,811 | B1 | 8/2003 | Holden et al. | |
| 6,851,346 | B1 | 2/2005 | Herring | |
| 6,871,437 | B1 | 3/2005 | Bartozzi et al. | |
| 7,261,029 | B1 | 8/2007 | Davis | |
| 7,364,057 | B2 | 4/2008 | Carroll | |
| 7,497,044 | B2 | 3/2009 | Cammenga et al. | |
| 7,562,614 | B2 | 7/2009 | Polston | |
| 7,568,422 | B1 | 8/2009 | Barrett | |

(Continued)

FOREIGN PATENT DOCUMENTS

WO 0029802 A2 5/2000

OTHER PUBLICATIONS

International Search Report mailed Jan. 18, 2012.

*Primary Examiner* — Stephen M Johnson
(74) *Attorney, Agent, or Firm* — Gifford, Krass, Sprinkle, Anderson & Citkowski, P.C.; Douglas J. McEvoy

(57) ABSTRACT

A bolt catch assembly for use with a firearm including a receiver with an exposed receiving chamber and an underside engageable magazine. The assembly includes a bolt catch actuator housing supported in seating fashion relative to the receiving chamber and communicating with an attachable magazine. A catch actuator is supported in elevatable fashion relative to an end of the actuator housing. A follower component is upwardly and biasingly disposed within the magazine and which, upon contacting the catch actuator, displaces an associated bolt catch of the firearm in an upper and bolt restraining position.

19 Claims, 5 Drawing Sheets

U.S. PATENT DOCUMENTS

| | | | |
|---|---|---|---|
| 7,661,219 | B1 | 2/2010 | Knight, Jr. et al. |
| 7,823,312 | B2 | 11/2010 | Faifer |
| 7,937,872 | B1 | 5/2011 | Fluhr |
| 2005/0000138 | A1 | 1/2005 | Kiss |
| 2005/0183310 | A1 | 8/2005 | Finn |
| 2008/0092733 | A1 | 4/2008 | Leitner-Wise et al. |
| 2009/0288326 | A1 | 11/2009 | Twardy |
| 2011/0078937 | A1 | 4/2011 | Rich |
| 2011/0079132 | A1 | 4/2011 | Rich |
| 2011/0107902 | A1 | 5/2011 | Quetschke et al. |

* cited by examiner

DROP BOLT HOLD OPEN ACTUATOR FOR USE WITH AR-15/M16 TYPE FIREARMS AND INCORPORATING A MODIFIED AND DISPLACEABLE FOLLOWER FOR ENGAGING A BOLT CATCH MECHANISM SUCH AS IN CONJUNCTION WITH RIMFIRE AMMUNITION

CROSS-REFERENCE TO RELATED APPLICATIONS

This application claims the benefit of U.S. Provisional Application 61/321,942 filed on Apr. 8, 2010.

FIELD OF THE INVENTION

The present invention relates generally to a drop bolt catch kit for establishing a last shot bolt hold open position. More specifically, the present invention teaches a combination bolt catch accessory fitting between upper and lower receiver assemblies associated with such as right or left handed AR-15 firearms, in combination with a uniquely configured magazine supported follower, and which provides full function bolt hold open/release capabilities. The combination catch assembly and follower is capable of functioning with rim fire conversion ammunition.

BACKGROUND OF THE INVENTION

The incorporation of bolt catch mechanism, such as in use with AR-15/M-16 type firearms is known in the art, one purpose for which being the ability to hold open a bolt or slide of a firearm firing mechanism in order to inspect the chamber after all rounds supplied by a magazine have been discharged. One known example of an ammunition magazine with internally supported and upwardly spring biased follower body is disclosed in Westrom, U.S. Pat. No. 5,638,626 and which discloses a bolt catch actuator coupled to the follower. The actuator is biasingly seated within the follower and further exhibits an actuation finger which, upon aligning the follower with a notch indicative of a last shot being fired, projects the finger through the notch in order to contact the bolt catch and restrain the reciprocating bolt in the open position.

SUMMARY OF THE INVENTION

The present invention discloses a bolt catch assembly for use with a firearm including a receiver with an exposed receiving chamber and an underside engageable magazine. The assembly includes a bolt catch actuator housing supported in seating fashion relative to the receiving chamber and communicating with an attachable magazine. A catch actuator is supported in elevatable fashion relative to an end of the actuator housing. A follower component is upwardly and biasingly disposed within the magazine and which, upon contacting the catch actuator, displaces an associated bolt catch of the firearm in an upper and bolt restraining position.

The follower component exhibits a main body having a three dimensional shape and overall profile matching a cross sectional interior of the magazine and influenced in a generally upwardly biasing direction. An upper follower body extends at least a length of the main body and is supported in displacing fashion relative to the main body. The main body exhibits an upper configured and lengthwise extending channel, a partial superstructure supported within the channel, and a pair of side defined and upper end proximate slots.

Additional features include the upper follower body exhibiting an upper displaceable member which exhibits a generally elongated rectangular configuration seating within the lengthwise extending channel. The upper follower body also exhibits a lower ledge support and an upper angled/projecting catch actuator engaging portion.

A pair of seating pins extend through communicating locations with the slots, as well as like dimensional width apertures extending through the upper displaceable member. A spring is supported in an extending and seating fashion within a hidden location of the superstructure so that an opposite end is biased an abutting end surface of the upper follower body in a rearward induced direction. Other features include a modification of the actuator housing to incorporate an adjustment screw for adjusting a range of displacement of the upper displaceable member.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Referring now to the several illustrations, the present invention teaches a bolt catch accessory and uniquely configured follower which can be installed between upper and lower receiver assemblies associated with any suitable firearm, but in one applicable variant to any of a related family of M-16 or AR-15 firearms. As further previously indicated, the bolt catch provides an improved and more secure assembly for achieving last shot bolt hold open position than is capable with prior art devices.

As will further be described in detail with reference to the several illustrations, the invention includes, as a first component, a bolt catch actuator housing supported in drop-in fashion within an upper exposed rim of a lower receiver housing chamber and which includes an end supported and elevatable bolt catch actuator for in turn engaging a conventional bolt catch component associated with a reciprocating bolt of the firearm. An associated follower component includes a main body with an upper configured and lengthwise extending channel, within which is seated a spring loaded and shifting upper component.

The bolt catch assembly (see as defined by actuator housing 10 and associated bolt catch actuator 12) is particularly configured for operating with rim fire ammunition (as opposed to center fire ammunition in which the firing pin strikes a primer cap at the center of a base of the cartridge). As is further known, rim fire ammunition includes a widened base rim which is essentially a widened percussion cap containing the desired priming compound, while the associated cartridge case itself contains the propellant powder and projectile (bullet).

Figure 1:
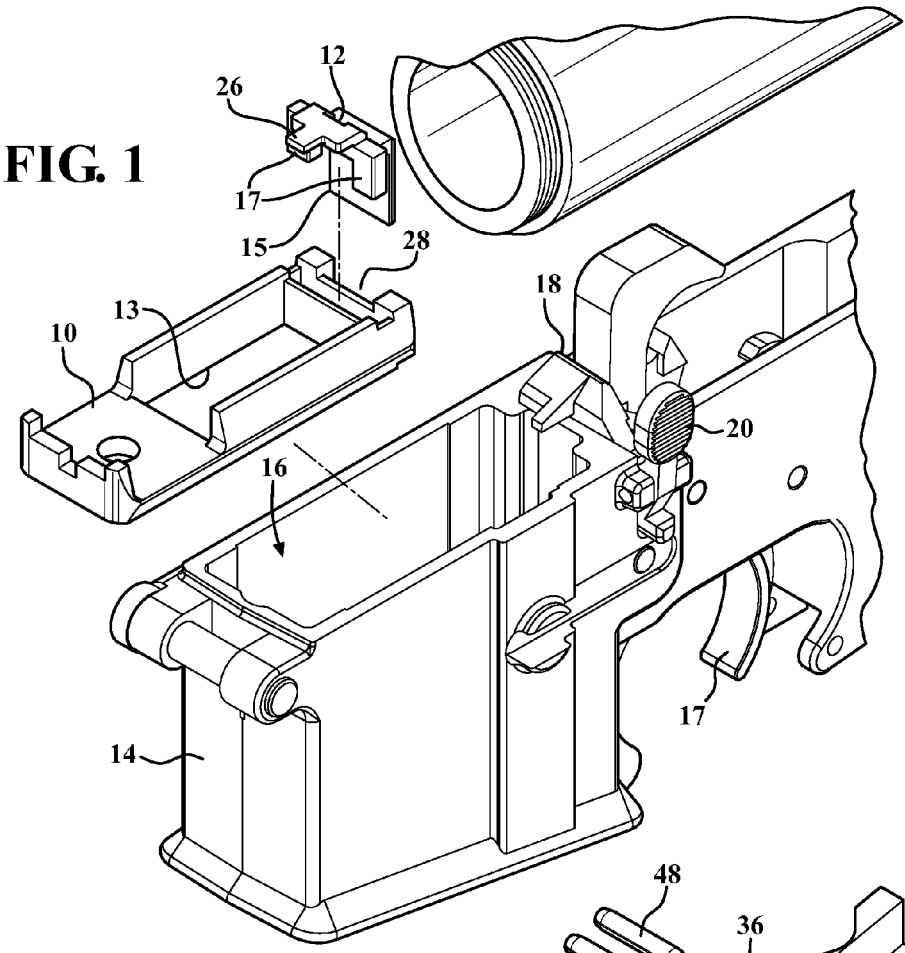
FIG. 1 is an exploded perspective of a lower receiver with exposed receiving chamber for communicating with an attachable magazine and within which is drop installed the bolt catch actuator and housing.

Referring to FIG. 1, a sectional perspective is shown of a lower receiver 14 with exposed receiving chamber, further generally shown at 16 in proximate location to a trigger assembly 17. The bolt catch actuator housing 10 and (optionally) attachable catch actuator 12 is again shown in seating (or drop in) fashion relative to the open receiving chamber 16 and for communicating with an attachable magazine (not shown but understood to include a conventional multiple cartridge supporting article with a generally hollowed interior and which is engaged with an underside of the receiver 14 in communication with the exposed chamber 16). As further depicted in FIG. 1, the catch actuator 12 depicts an inner rectangular perimeter 13 which communicates with the exposed receiving chamber 16 upon assembly.

As further shown, the bolt catch actuator 12 fits into the actuator housing 10 as a packaged unit, and which in turn is placed within the open magazine well (again exposed chamber 16), such that the associated bolt catch 18 is captured or otherwise slaved to the catch actuator 12. In this fashion, the assembly is secured between the upper (not shown) and lower 14 receivers upon reassembly.

The bolt catch combines an integrally formed actuator catch engaging portion, again as shown at 18, in combination with a user accessible (e.g. thumb displacing) portion 20 such as for manually triggering the catch engaging portion. The catch actuator 12 further includes such as an open configured window, hidden from view in FIG. 1 however through which the catch 18 projects (see again FIGS. 3 and 4) in order to be displaced in response to elevating motion exerted upon the catch actuator, such as by a follower component (see as generally shown in exploded fashion at 24 in FIG. 2) and which is further biasingly disposed within the magazine by such as a spring underneath the last of a plurality of cartridges (also not shown) which are progressively discharged by virtue of the firearms operation.

Figure 3:
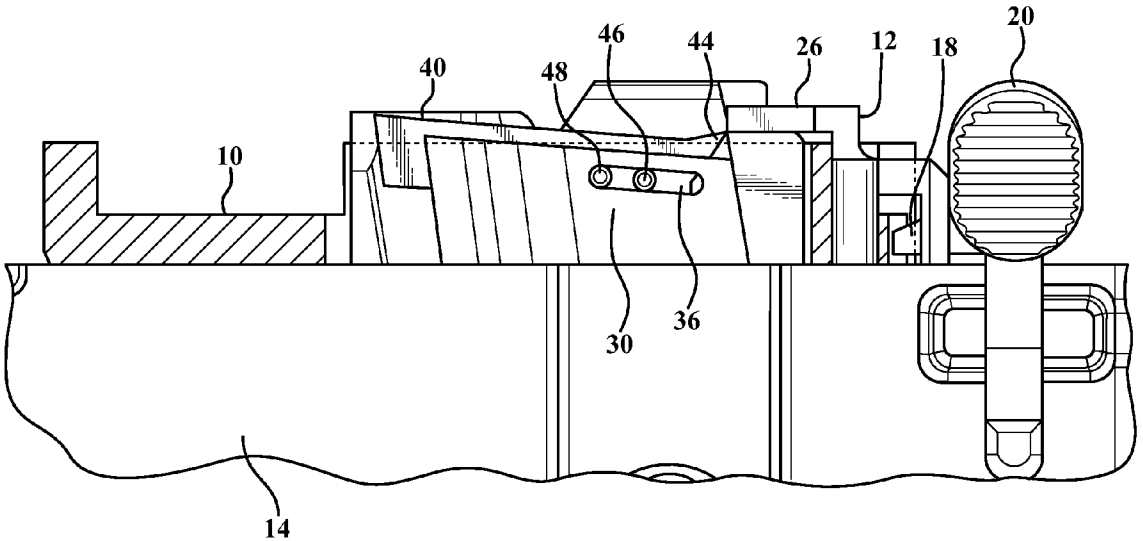
FIG. 3 is an enlarged and cutaway side view illustration of the combination bolt catch actuator and follower components, following discharge of a remaining cartridge, in an initial contact position relative to the bolt catch actuator.
Figure 4:
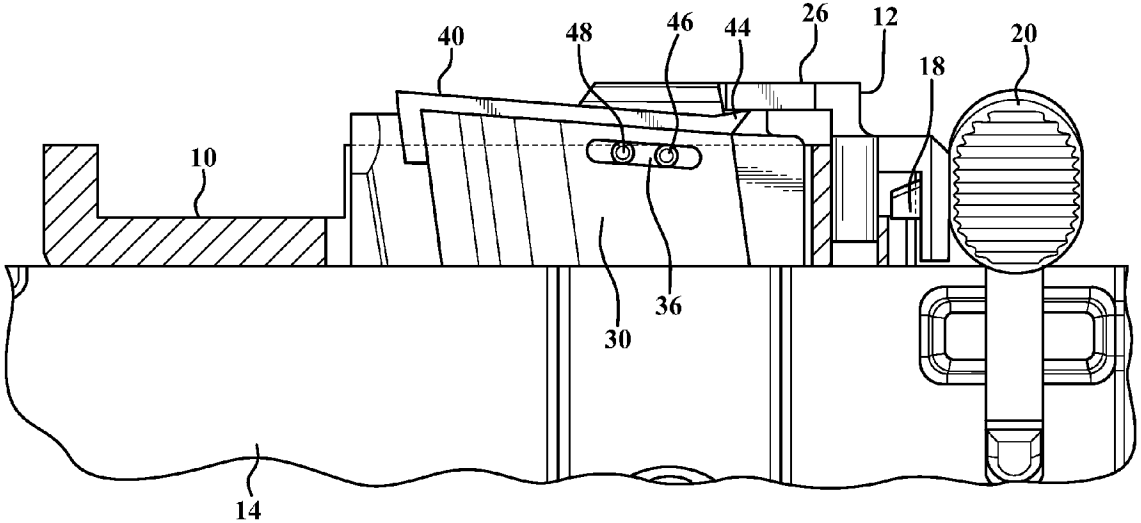
FIG. 4 is a succeeding illustration to FIG. 3 and in which a magazine exerted spring action applied to the follower results in its biasing upwardly to an uppermost position, at which the channel supported and length displaceable extending member is caused to incrementally displace in contact with the bolt catch actuator to in turn elevate a slaved bolt catch component.

The follower subassembly 24, in its uppermost displaced position within the attached magazine as depicted in the side cutaway of FIG. 4, engages a tab 26 extending from a top of the catch actuator 12 and which extends over the communicating interior of the bolt catch actuator housing and in communicating alignment with the exposed receiving chamber 16). As further best shown in FIG. 1, the bolt catch housing 10 exhibits an end configured location 28, which is largely hidden from view in FIG. 3 but is understood to include a step and ledge profile which enables the underside of the catch actuator 12 to be supported in each of a seated rest position (FIG. 3) as well as follower induced and upwardly displaced position (FIG. 4). Support of the catch actuator 12 is further facilitated by vertically extending and spaced apart supports including outer structure 15 and inner spaced legs or tabs 17, these straddling therebetween the end supporting location 28 to facilitate controlled vertical displacement of the catch actuator 12.

Further variants of the invention contemplate use of the bolt catch actuator housing 10, without the associated bolt catch actuator 12. This can occur in situations where other (e.g. non rim fire) cartridges are employed and where it is desired to employ the actuator housing 10 alone in order to provide for a tighter fit with the upper engaging end of the magazine 18.

Referring again to FIG. 2, the follower mechanism 24 is again shown forming a component of the invention in combination with the catch actuator 12 and associated housing 10. The follower 24 includes a main body 30 exhibiting a three dimensional shape and overall profile matching a cross sectional interior of an attachable magazine suitable for engaging to the AR-15 receiver housing 14. Upon the follower body 30 being installed within the open interior of the magazine, it is influenced in a generally upwardly biasing direction by an inner spring (not shown) supported within a base of the magazine and contacting an underside of the body 30. In this fashion, the body 30 is displaced in a progressive upward fashion resulting from repeated discharge of the cartridges supported within the magazine.

An upper configured and lengthwise extending channel is illustrated generally at 32 within an upper facing surface of the follower body 30, and which is defines a generally "U" shaped profile within a top of the main follower body 30. Additional features evident include a partial superstructure 34 supported within the follower channel proximate one end thereof, along with a pair of opposite side defined and upper end proximate slots 36 and 38.

The follower subassembly also includes an upper displaceable member 40 which exhibits a generally elongated rectangular configuration suitable for seating within the upper channel profile 32 of the lower follower body 30. The upper displaceable member 40 includes a length profile at least equal to and optionally greater to that of the lower body 30 and, at a rearward facing end, includes a lower ledge support 42 and an upper angled/projecting catch actuator engaging portion 44.

The configuration of the upper follower member 40 is further such that it is capable of being supported in lengthwise displaceable fashion within the channeled profile 32 of the lower body, in supported fashion upon the partial superstructure 34, and so that the arrangement and configuration of the ledge support 42 prevents the member 40 form pivoting or rocking during rear length displacement movement (see FIGS. 3 and 4).

Additional features include a pair of seating pins 46 and 48 which extend through the previously defined slots 36 and 38 as well as like dimensional width wise extending apertures 50 and 52 formed through the upper displaceable follower portion 40. A spring 54 is also provided and is supported in a seating fashion within a hidden location of the superstructure 34 so that an opposite end of the spring 54 biases an abutting end surface of the upper follower 40 in a rearward induced shifting direction (as further depicted by directional arrow 56).

In this fashion, and as is shown in FIGS. 3 and 4, the upper follower 40 is caused to lengthwise displace in a combined downward and rearward direction, upon being elevated into an uppermost contact position with the bolt catch actuator 12 and following discharge of a final cartridge (not shown). As a further result of the engagement established between the angled follower contact portion 44 and the underside of the overhanging contact ledge associated with the bolt catch actuator 12, the upper follower body 40 is caused to lengthwise displace to a degree evident in the upper most displaced position of FIG. 4 and upon the upper displacing follower 40 clearing the upper surface of the receiver housing and associated well 16, within which is drop seated the bolt catch actuator housing 10.

Referring to each of FIGS. 5 and 5A-5E, a series of perspective, plan and exploded views are successively depicted of a modification of bolt catch actuator housing 58 and which is largely similar to that previously depicted at 10 in FIG. 1 exhibiting a generally elongated configuration and with a rectangular inwardly facing closed perimeter 60 defining an internal opening which communicates with the receiver chamber 16. An adjustable screw 62 (illustrated in each of FIGS. 5C, 5D and 5E) is incorporated into a bottom end location of the housing 58, see also internally threaded aperture 64 in FIG. 5E, such that rotative displacement of the screw 62 results in contact with and vertical displacement of an underside abutting location associated with a support structure 66 of a catch actuator 68 and for vertically raising and lowering the catch actuator 68 to an optimal height location, such as to remove and residual slack or play in the actuator, and in order to ensure that the bolt catch 18 does not interfere with reciprocating bolt operation until a last round within the magazine is discharged.

Figure 5:
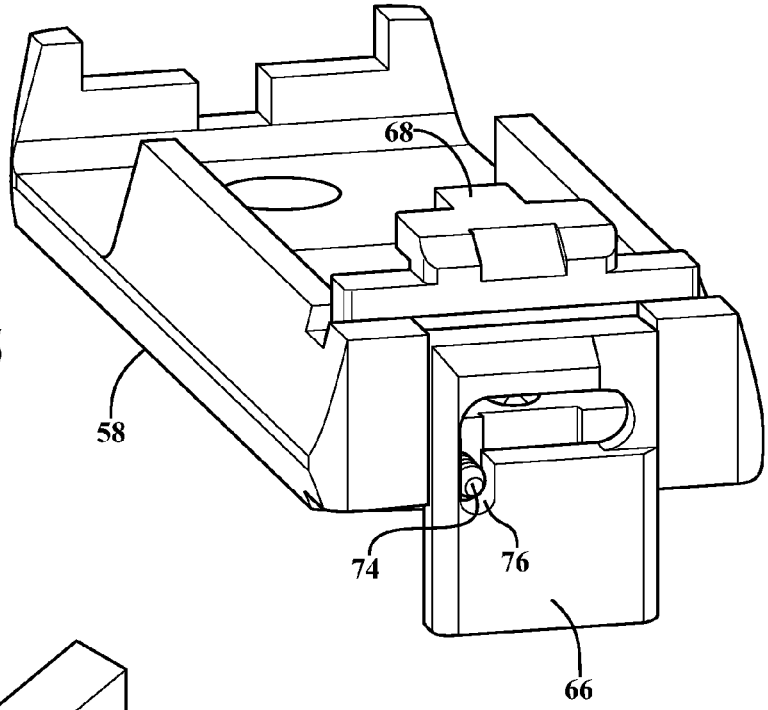
FIG. 5 is an enlarged sectional perspective of a modification of the actuator housing and which incorporates an adjustment screw for modifying a range of positioning of the catch actuator to establish a contact location with the upper displaceable member.

Additional features also depicted in the earlier variant 12 of the catch actuator again include a further pair of inwardly spaced legs or tabs 70 (FIG. 5E) relative to the outer support structure 66 in order to support the catch actuator 68 upon an edge defined surface 72 (again FIG. 5E) of the housing 58. A secondary locating pin 74 is installed horizontally through a slot 76 (as best shown in FIG. 5) and engaged through a further aperture 78 (FIG. 5E) in order to define a range of vertical motion of the catch actuator as defined by the vertical component of the slot 76 in the support structure 66.

Figure 2:
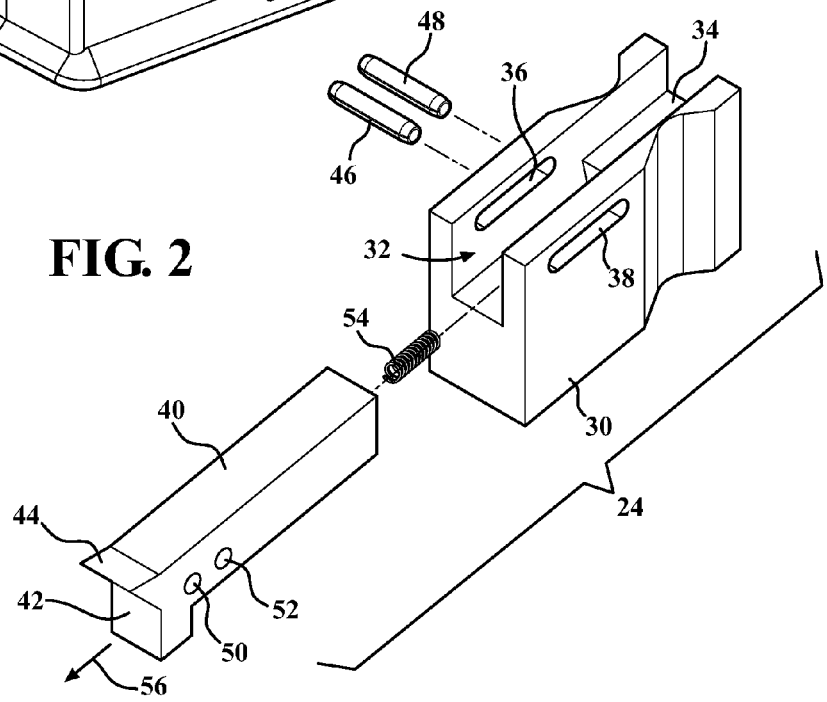
FIG. 2 is a further sectional perspective of a follower mechanism forming a component of the invention and which includes a main body with an upper configured and lengthwise extending channel within which is seated a spring loaded and shifting upper component.
Figure 6:
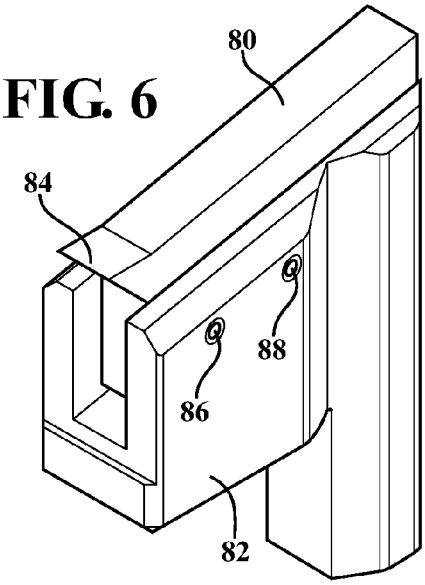
FIG. 6 is an assembled illustration of a follower mechanism similar to that shown in FIG. 2 and in which the upper displaceable member is shown in a first design (pre-shifted normal) configuration.
Figure 7:
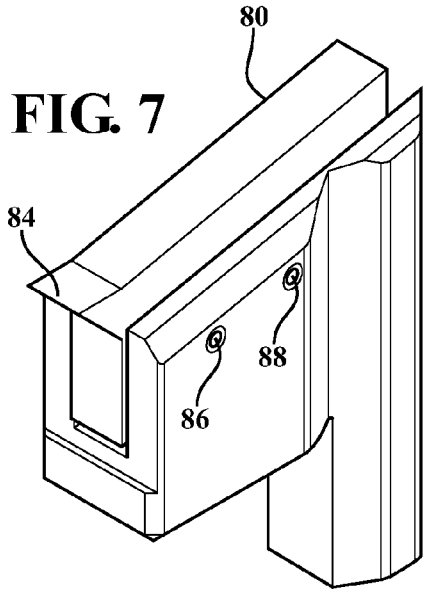
FIG. 7 is a succeeding illustration to FIG. 6 and depicting the upper displaceable member in a succeeding shifted configuration.
Figure 5A:
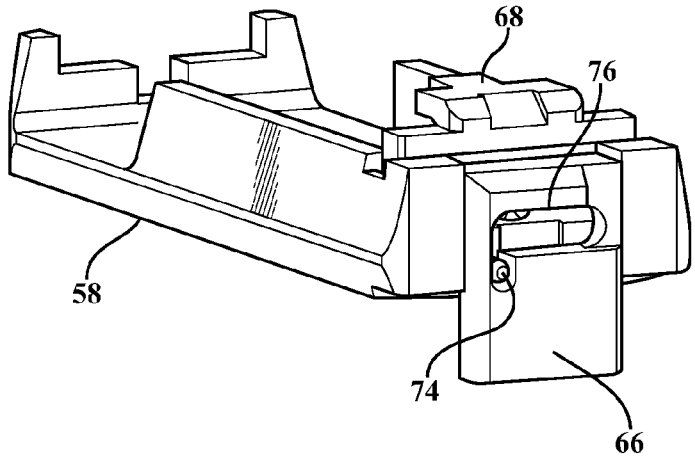
FIGS. 5A-5E present a variety of perspective, plan and exploded view of the modified actuator housing depicted in FIG. 5 and further illustrating the feature of the bottom adjustable screw for vertically raising and lowering the catch actuator to an optimal height location, such as to remove and residual slack or play in the actuator, and in order to ensure that the bolt catch does not interfere with reciprocating bolt operation until a last round within the magazine is discharged.
Figure 5B:
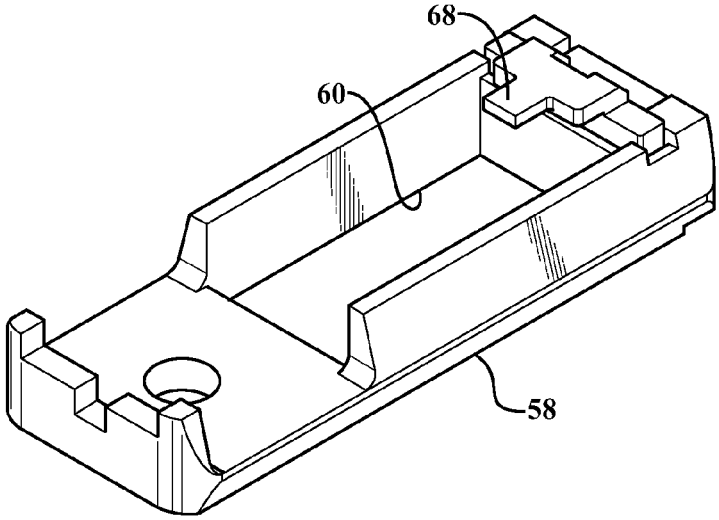
Figure 5C:
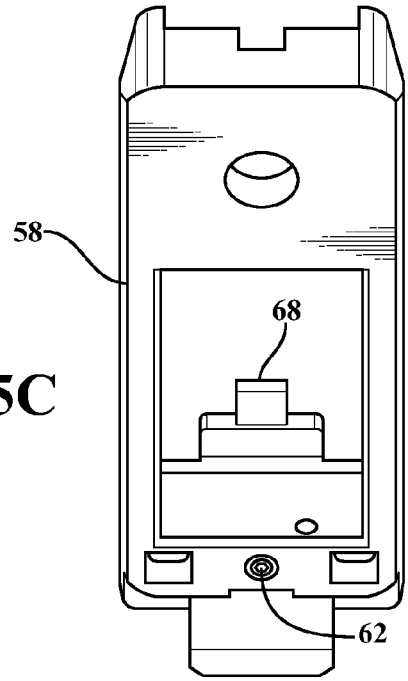
Figure 5D:
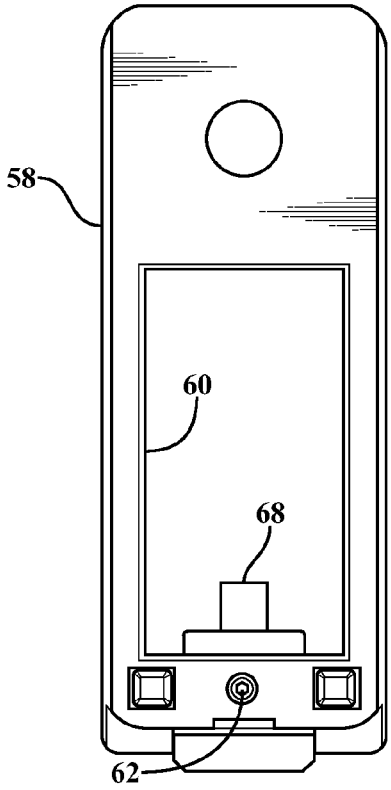
Figure 5E:
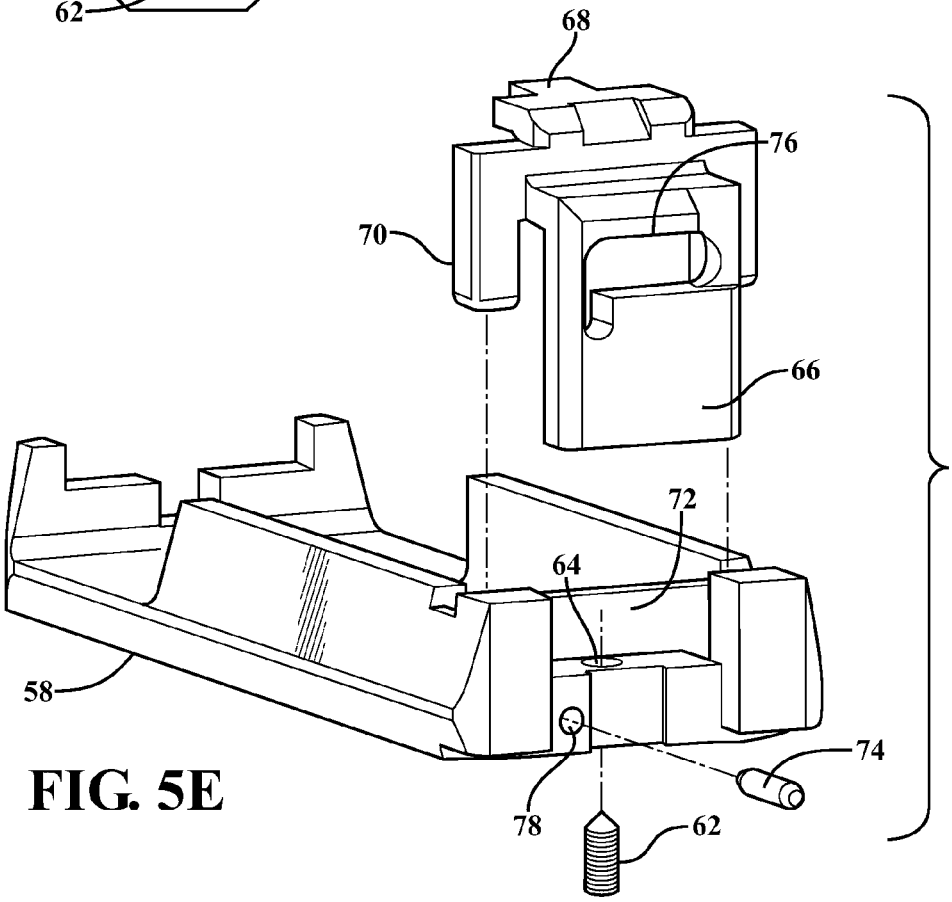

FIG. 6 is an assembled illustration of a follower mechanism similar to that shown in FIG. 2 and in which an upper displaceable member 80 (similar to that previously described at 40) is shown in a first design (pre-shifted normal) configuration relative to a lower seating and supporting follower body 82. FIG. 7 is a succeeding illustration to FIG. 6 and depicting the upper displaceable member 80, and in particular its angled upper catch actuating edge portion 84 in a succeeding shifted configuration. Displacement of the upper member 80 can be facilitated by slotting its interior (which is hidden from view but understood to be in a similar manner depicted by slots 36 and 38 defined in the sides of the follower body 30 in FIG. 2), and by which fixed widthwise extending pins 86 and 88 are supported by the body 82 and extending through such a slot formed in the interior of the displaceable member 80.

As is known, an associated bolt (not shown) is a mechanical part of the firearm which blocks a rear of the associated chamber during burning of the propellant. In semi-automatic firearms, such as is the case AR-15 type firearms, the bolt is caused to cycle back and forth during each cartridge discharge cycle, propelled by recoil/expanding gas (backwards) or spring recoil (forwards). Upon moving back, an elongated lug disposed upon a bottom of the reciprocating bolt strips the cartridge casing (also not shown) from the magazine and pushes it into the firearm chamber. Upon discharge, and once the spent shell casing case is clear of the chamber, an ejector component (also not shown but understood to also include an integral component of the bolt along with the firing pin), ejects the casing from the receiver and out of the firearm.

In operation, the interface between the follower assembly 24 and the bolt catch actuator 12 and housing 10 operate to provide a last shot bolt open condition, such as in conjunction with a rimfire style ammunition which varies the engagement structure established between the firearm configured bolt catch 18/20 and shell base.

Having described my invention, other and additional preferred embodiments will become apparent to those skilled in the art to which it pertains, and without deviating from the scope of the appended claims.

We claim:

1. A bolt catch assembly incorporated into a firearm, the firearm including a receiver with an exposed receiving chamber to which is attached a multiple cartridge supporting magazine, said assembly further comprising:

a bolt catch actuator housing supported in seating fashion relative to the receiving chamber and communicating with the attachable magazine;

a catch actuator supported in elevated fashion relative to an end of said actuator housing; and a follower upwardly and biasingly disposed within the magazine which, upon contacting said catch actuator, displacing an associated bolt catch of the firearm to an upper and bolt restraining position, said follower further having a main body exhibiting a three dimensional shape and overall profile matching a cross sectional interior of the magazine and being influenced in a generally upwardly biasing direction, an upper follower body extending at least a length of said main body and being supported in lengthwise displacing fashion relative to said main body.

2. The assembly as described in claim 1, said main body further comprising an upper configured and lengthwise extending channel, a partial superstructure supported within said channel, and a pair of side defined and upper end proximate slots.

3. The assembly as described in claim 2, said upper follower body further comprising an upper displaceable member which exhibits a generally elongated rectangular configuration seating within said lengthwise extending channel.

4. The assembly as described in claim 3, said upper follower body further comprising a lower ledge support and an upper angled/projecting catch actuator engaging portion.

5. The assembly as described in claim 3, further comprising a pair of seating pins which extend through communicating locations with said slots as well as like dimensional width apertures extending through the upper displaceable member.

6. The assembly as described in claim 3, further comprising a spring supported in an extending and seating fashion within a hidden location of said superstructure so that an opposite end is biased an abutting end surface of the upper follower body in a rearward induced direction.

7. The assembly as described in claim 1, further comprising an adjustable screw incorporated into a bottom end location of said housing and, upon rotating, vertically displacing said catch actuator in either of opposite linear directions to modify a contact location established with said upper follower body.

8. A bolt catch assembly incorporated into a firearm, the firearm including a receiver with an exposed receiving chamber to which is attached a multiple cartridge supporting magazine, said assembly further comprising:

a bolt catch actuator housing supported in seating fashion relative to the receiving chamber and communicating with the attachable magazine;

a catch actuator supported in elevated fashion relative to an end of said actuator housing;

a follower including a main body exhibiting a three dimensional shape and overall profile matching a cross sectional interior of the magazine, said main body further having an upper configured and lengthwise extending channel, a partial superstructure supported within said channel and a pair of side defined and upper end proximate slots extending along sides of said main body such that said main body is influenced in a generally upwardly biasing direction; and an upper follower body extending a length at least equal to said main body and being supported in displacing fashion relative to said main body, said follower being upwardly and biasingly disposed within the magazine and, upon said upper follower body contacting said catch actuator, displacing an associated bolt catch of the firearm to an upper and bolt restraining position.

9. The assembly as described in claim 8, said upper follower body further comprising an upper displaceable member which exhibits a generally elongated rectangular configuration seating within said lengthwise extending channel.

10. The assembly as described in claim 9, said upper follower body further comprising a lower ledge support and an upper angled/projecting catch actuator engaging portion.

11. The assembly as described in claim 9, further comprising a pair of seating pins which extend through communicating locations with said slots as well as like dimensional width apertures extending through the upper displaceable member.

12. The assembly as described in claim 9, further comprising a spring supported in an extending and seating fashion within a hidden location of said superstructure so that an opposite end is biased an abutting end surface of the upper follower body in a rearward induced direction.

13. The assembly as described in claim 8, further comprising an adjustable screw incorporated into a bottom end location of said housing and, upon rotating, vertically displacing said catch actuator in either of opposite linear directions to modify a contact location established with said upper follower body.

14. A bolt catch assembly incorporated into a firearm, the firearm including a receiver with an exposed receiving chamber to which is attached a multiple cartridge supporting magazine, said assembly further comprising:

a bolt catch actuator housing supported in seating fashion relative to the receiving chamber and communicating with the attachable magazine;

a catch actuator supported in elevated fashion relative to an end of said actuator housing, a locating pin installed horizontally through a slot in said catch actuator in alignment with an aperture in said bolt catch actuator housing in order to define a range of vertical motion of said catch actuator as defined by a vertical component of said slot in said catch actuator; and a follower including a main body exhibiting a three dimensional shape and overall profile matching a cross sectional interior of the magazine and being influenced in a generally upwardly biasing direction, an upper follower body extending a length at least equal to said main body and being supported in a lengthwise displacing fashion relative to said main body;

said follower being upwardly and biasingly disposed within the magazine and, upon said upper follower body contacting said catch actuator, displacing an associated bolt catch of the firearm to an upper and bolt restraining position.

15. The assembly as described in claim 14, said main body further comprising an upper configured and lengthwise extending channel, a partial superstructure supported within said channel, and a pair of side defined and upper end proximate slots.

16. The assembly as described in claim 15, said upper follower body further comprising an upper displaceable member which exhibits a generally elongated rectangular configuration seating within said lengthwise extending channel, said upper follower body further comprising a lower ledge support and an upper angled/projecting catch actuator engaging portion, a spring supported in an extending and seating fashion within a hidden location of said superstructure so that an opposite end is biased an abutting end surface of the upper follower body in a rearward induced direction.

17. The assembly as described in claim 15, further comprising a pair of seating pins which extend through communicating locations with said slots as well as like dimensional width apertures extending through the upper displaceable member.

18. The assembly as described in claim 14, further comprising an adjustable screw incorporated into a bottom end location of said housing and, upon rotating, vertically displacing said catch actuator in either of opposite linear directions to modify a contact location established with said upper follower body.

19. A bolt catch assembly incorporated into a firearm, the firearm including a receiver with an exposed receiving chamber to which is attached a multiple cartridge supporting magazine, said assembly further comprising:

a bolt catch actuator housing supported in seating fashion relative to the receiving chamber and communicating with an attachable magazine;

a catch actuator supported in elevated fashion relative to an end of said actuator housing;

a follower including a main body exhibiting a three dimensional shape and overall profile matching a cross sectional interior of the magazine and being influenced in a generally upwardly biasing direction, an upper follower body extending a length at least equal to said main body and being supported in displacing fashion relative to said main body, said follower being upwardly and biasingly disposed within the magazine and, upon said upper follower body contacting said catch actuator, displacing an associated bolt catch of the firearm to an upper and bolt restraining position; and an adjustable screw incorporated into a bottom end location of said housing and, upon rotating, vertically displacing said catch actuator in either of opposite linear directions to modify a contact location established with said upper follower body.

* * * * *